US010957298B2

(12) United States Patent
Yoon et al.

(10) Patent No.: US 10,957,298 B2
(45) Date of Patent: Mar. 23, 2021

(54) ACOUSTIC RESONATOR

(71) Applicant: Research & Business Foundation Sungkyunkwan University, Suwon-si (KR)

(72) Inventors: Suk Wang Yoon, Seoul (KR); Wan-Gu Kim, Seongnam-si (KR); Hwi Suk Kang, Suwon-si (KR)

(73) Assignee: Research & Business Foundation Sungkyunkwan University, Suwon-si (KR)

( * ) Notice: Subject to any disclaimer, the term of this patent is extended or adjusted under 35 U.S.C. 154(b) by 207 days.

(21) Appl. No.: 15/983,740

(22) Filed: May 18, 2018

(65) Prior Publication Data

US 2018/0337653 A1 Nov. 22, 2018

(30) Foreign Application Priority Data

May 18, 2017 (KR) ..... 10-2017-0061895

(51) Int. Cl.
*G10K 11/172* (2006.01)
*G10K 11/16* (2006.01)
*G10K 11/04* (2006.01)

(52) U.S. Cl.
CPC ..... *G10K 11/172* (2013.01); *G10K 11/04* (2013.01); *G10K 11/16* (2013.01)

(58) Field of Classification Search
CPC ..... G10K 11/04; G10K 11/16; G10K 11/172; G10K 2210/3224; G10K 2210/3227; F02M 35/1255; F24F 2013/245; B60R 13/0884
USPC ..... 181/224, 229
See application file for complete search history.

(56) References Cited

U.S. PATENT DOCUMENTS 4,135,603 A * 1/1979 Dean, III ..... G10K 11/172 181/286
4,189,027 A * 2/1980 Dean, III ..... G10K 11/172 181/286
4,924,966 A * 5/1990 Kanda ..... F01N 1/02 181/228
6,341,663 B1 * 1/2002 Alex ..... F01N 1/006 181/249
6,422,192 B1 * 7/2002 Bloomer ..... F02M 35/1222 123/184.57
6,581,722 B2 * 6/2003 Faulhaber ..... F16L 55/033 181/227
6,932,189 B2 * 8/2005 Helber ..... F01N 1/06 123/184.59
7,089,901 B2 * 8/2006 Kino ..... F02M 35/1222 123/184.57
9,302,537 B2 * 4/2016 Zhu ..... B60B 21/00
(Continued)

FOREIGN PATENT DOCUMENTS

JP 2000241226 A * 9/2000
JP 2013/218026 A 10/2013
(Continued)

*Primary Examiner* — Jeremy A Luks
(74) *Attorney, Agent, or Firm* — NSIP Law

(57) ABSTRACT

An acoustic resonator according to the present invention includes a fluid accommodation part having a space portion configured to accommodate a fluid, and openings, closing portions configured to close the openings, and a compressibility reduction portion configured to vent the space portion to reduce effective compressibility of the fluid accommodation part.

16 Claims, 12 Drawing Sheets

(56) References Cited

U.S. PATENT DOCUMENTS

| | | | | |
|---|---|---|---|---|
| 9,604,583 | B2 * | 3/2017 | Seo | B60R 13/0884 |
| 9,697,817 | B2 * | 7/2017 | Zalewski | B33Y 80/00 |
| 10,386,065 | B2 * | 8/2019 | Liu | F23M 20/005 |
| 10,546,070 | B2 * | 1/2020 | Hellat | F23R 3/002 |
| 2005/0098379 | A1 * | 5/2005 | Sato | B60R 13/0815 181/293 |
| 2005/0224283 | A1 * | 10/2005 | Yokoi | F01N 1/084 181/268 |

FOREIGN PATENT DOCUMENTS

| | | | | |
|---|---|---|---|---|
| JP | 2016142232 | A * | 8/2016 | F04C 29/065 |
| KR | 10-1598294 | B1 | 2/2016 | |

* cited by examiner

ACOUSTIC RESONATOR

BACKGROUND

1. Field of the Invention

The present invention relates to an acoustic resonator, and more particularly, to an acoustic resonator which is able to realize a desired resonance frequency or Q factor with a fixed length, or is designable to have a desired length while realizing a fixed resonance frequency or Q factor.

2. Discussion of Related Art

A general acoustic resonator corresponds to a device configured to extract a sound wave having a specific frequency by using a resonance phenomenon. Such an acoustic resonator may be applied to a vehicle or an air conditioner and may be used to block the noise generated during operation of a corresponding device.

However, in a conventional acoustic resonator, since a length of a device should satisfy a physical relation depending on the wavelength of an input sound wave, a length, a shape, and the like of a product are limited. Thus, a design of an acoustic resonator itself or a device on which the acoustic resonator is mounted is limited. Therefore, there is a need to solve such a problem.

The background art of the present invention is disclosed in Korea Patent Registration No. 10-1598294 (entitled "ACOUSTIC RESONATOR AND MANUFACTURING METHOD thereof" registered on Feb. 22, 2016).

SUMMARY OF THE INVENTION

The present invention has been made to solve the above problem and is directed to providing an acoustic resonator which is able to realize a desired resonance frequency or Q factor in the state in which a length thereof is fixed, or is designable to have a desired length as well as a fixed resonance frequency or Q factor.

An acoustic resonator according to an exemplary embodiment of the present invention includes: a fluid accommodation part having a space portion configured to accommodate a fluid, and openings; closing portions configured to close the openings; and a compressibility reduction portion configured to vent the space portion to reduce effective compressibility of the fluid accommodation part.

The acoustic resonator according to the exemplary embodiment of the present invention may further include a density reduction portion configured to partition the space portion to reduce effective density of the fluid accommodation part.

An acoustic resonator according to another exemplary embodiment of the present invention includes: a fluid accommodation part having a space portion configured to accommodate a fluid, and openings; and a density reduction portion mounted in the fluid accommodation part and configured to partition the space portion to reduce effective density of the fluid accommodation part.

The acoustic resonator according to another exemplary embodiment of the present invention may further include a compressibility reduction portion configured to vent the space portion to reduce effective compressibility of the fluid accommodation part.

The space portion may be formed to pass through the fluid accommodation part in a lengthwise direction of the fluid accommodation part, and both ends of the space portion may be connected to the outside of the fluid accommodation part through the openings Air may be accommodated in the space portion, and the fluid accommodation part may be made with a material having acoustic impedance greater than that of the air.

The fluid accommodation part may be formed by connecting a plurality of accommodation units each having a length shorter than a wavelength of an applied sound wave.

The plurality of accommodation units may be arranged in series.

The compressibility reduction portion may have a side hole passing through the fluid accommodation part and may vent the space portion to the outside.

A plurality of compressibility reduction portions may be provided and arranged in a lengthwise direction of the fluid accommodation part.

The fluid accommodation part may be formed by connecting a plurality of accommodation units, and a plurality of compressibility reduction portions may be provided in the accommodation unit and may be arranged symmetrically with respect to a center in a lengthwise direction of the accommodation unit.

The fluid accommodation part may be formed by connecting a plurality of accommodation units, and a zeroth-order resonance frequency $\omega^{rigid}_{res}$ of an acoustic resonator including closing portions and compressibility reduction portion may be represented by $$\omega^{\text{rigid}}_{res} = \frac{1}{\sqrt{m_{ap}C_{ap}}},$$

wherein $m_{ap}$ is acoustic shunt inertance of a resonance unit including the accommodation unit and the compressibility reduction portion mounted in the accommodation unit, and $C_{ap}$ is acoustic shunt compliance of the resonance unit.

The density reduction portion may be composed of an elastic membrane which partition the space portion.

A plurality of density reduction portions may be provided and arranged in a lengthwise direction of the fluid accommodation part.

The fluid accommodation part may be formed by connecting a plurality of accommodation units, and a plurality of density reduction portions may be provided in the accommodation unit and may be arranged symmetrically with respect to the center in a lengthwise direction of the accommodation unit.

The fluid accommodation part may be formed by connecting a plurality of accommodation units, and a zeroth-order resonance frequency $\omega^{P.R.}_{res}$ of an acoustic resonator not including any closing portion and including density reduction portion may be represented by $$\omega^{P.R.}_{res} = \frac{1}{\sqrt{m_{as}C_{as}}},$$

wherein $m_{as}$ is acoustic series inertance of a resonance unit including the accommodation unit and the density reduction portion mounted in the accommodation unit, and $C_{as}$ is acoustic series compliance of the resonance unit.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
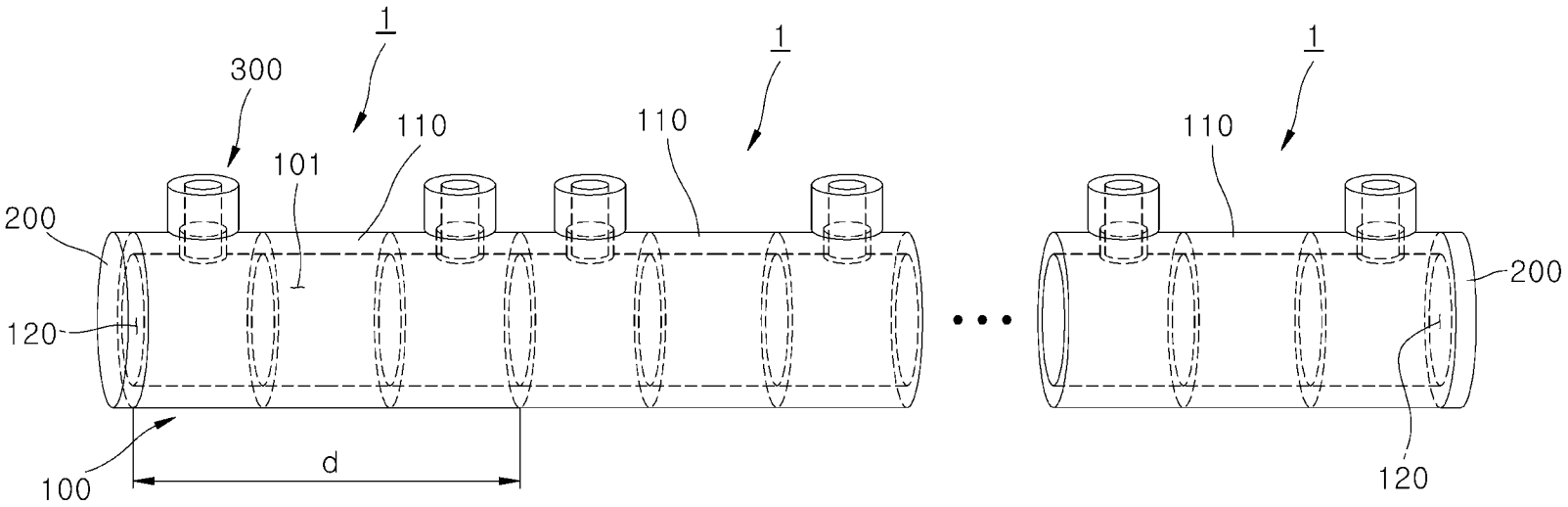
FIG. 1 is a schematic view illustrating an acoustic resonator according to a first exemplary embodiment of the present invention.

Hereinafter, exemplary embodiments of an acoustic resonator according to the present invention will be described with the accompanying drawings. In the drawings, the thicknesses of lines and the sizes of elements may be exaggerated for clarity and convenience.

In addition, the following terms are defined in consideration of functions used in the present invention, and can be changed according to the intent of a user or an operator, or a convention. Accordingly, definitions of the terms should be understood on the basis of the entire description of the present specification.

Figure 2:
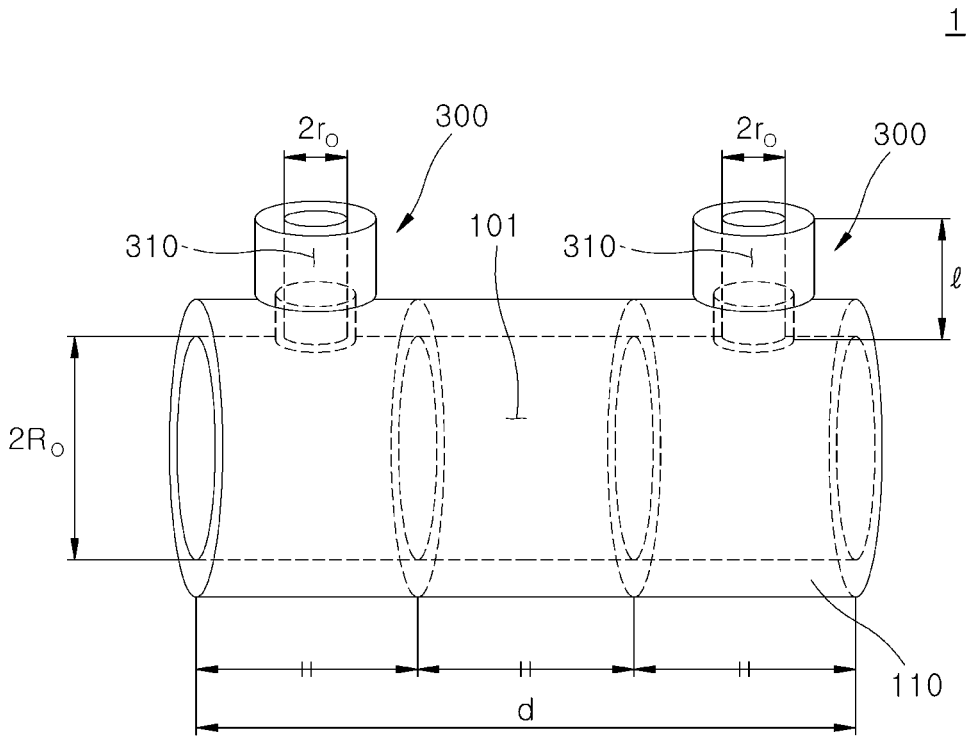
FIG. 2 is a schematic view illustrating an example of a resonance unit used in the acoustic resonator according to the first exemplary embodiment of the present invention.

FIG. 1 is a schematic view illustrating an acoustic resonator 10 according to a first exemplary embodiment of the present invention. The acoustic resonator 10 includes a structure formed by arranging a plurality of resonance units 1 in series, and closing portions 200 configured to close the openings 120 of both ends of the structure, each of a plurality of resonance units 1 including an accommodation unit 110 and compressibility reduction portions 300 attached to the accommodation unit 110. FIG. 2 is a schematic view illustrating an example of the resonance unit 1 used in the acoustic resonator 10 according to the first exemplary embodiment of the present invention.

Referring to FIGS. 1 and 2, the acoustic resonator 10 according to the first exemplary embodiment includes a fluid accommodation part 100, the closing portions 200, and the compressibility reduction portions 300 to cause resonance of a sound wave input to the fluid accommodation part 100.

The fluid accommodation part 100 has a space portion 101 formed therein, such that a fluid is accommodated therein. In the present exemplary embodiment, the fluid accommodation part 100 is formed in an approximate tubular shape such that the space portion 101 is formed to pass through the fluid accommodation part 100 in a lengthwise direction thereof. Each of both ends of the space portion 101 is connected to the outside of the fluid accommodation part 100 through the opening 120.

Cross sections of the space portion 101 and the opening 120 have the same shape. For example, when the cross sections of the space portion 101 and the opening 120 have circular shapes, the circular shapes may be formed to have the same inner diameter, i.e., $2R_0$. For example, inner cross sections of the space portion 101 and the opening 120 may be formed to have various shapes such as a circular shape and a polygonal shape.

The fluid accommodated in the space portion 101 is exemplified as air, and the fluid accommodation part 100 is made with a material having acoustic impedance greater than that of air. For example, the fluid accommodation part 100 may be made with a metal or polymer material having an acoustic impedance value greater than that of air.

In the present exemplary embodiment, the fluid accommodation part 100 may be formed by connecting a plurality of accommodation units 110 having a length d shorter than a wavelength of an applied sound wave. Specifically, the length d is considerably shorter than the wavelength $\lambda_{air}$ of the applied sound wave (i.e., $d \ll \lambda_{air}$).

As the length d of the accommodation unit 110, 110*a*, and 110*b* is shorter than a wavelength of an applied sound wave in an air medium, an equivalent circuit (see FIG. 7) more accurately models the accommodation unit 110, 110*a*, and 110*b*. Therefore, the fact that a condition of $d \ll \lambda_{air}$ is satisfied means that there exists a frequency region in which the behavior of a wave in acoustic resonators 10, 10*a*, and 10*b* or resonance units 1, 1*a*, and 1*b* is approximately represented by generalized Telegraphist's Equations, i.e., there exists a frequency region in which an effectively homogeneous condition of $d < \lambda_g/4$ is satisfied (wherein $\lambda_g$ indicates the wavelength in the lengthwise direction of the fluid accommodation part 100).

Figure 7:
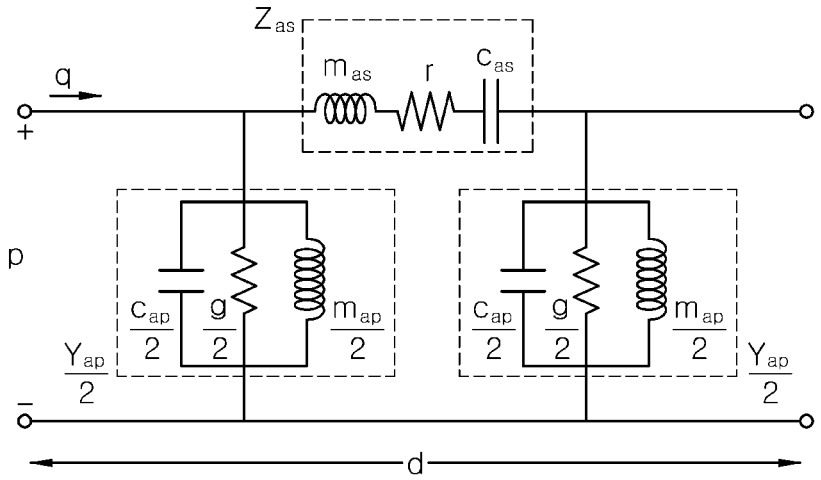
FIG. 7 is a diagram illustrating an equivalent circuit model of a resonance unit used in an acoustic resonator according to an exemplary embodiment of the present invention.

This ensures the establishment of the following Mathematical Equations 5 to 8 derived from an equivalent circuit model of FIG. 7, with respect to resonance frequency and Q factor of zeroth-order resonance.

As the length d of the accommodation unit 110 increases and thus departs from the condition of $d \ll \lambda_{air}$, the behavior of the wave in the acoustic resonators 10, 10*a*, and 10*b* or the resonance units 1, 1*a*, and 1*b* departs from the description by generalized Telegraphist's Equations. Consequently, an expected zeroth-order resonance phenomenon does not occur, or although the expected zeroth-order resonance phenomenon occurs, the error is increased between resonance frequency and Q factor thereof and the following Mathematical Equation 5 to 8 derived from the equivalent circuit model of FIG. 7.

The accommodation units 110 may be arranged in series, and the number and the arrangement of the accommodation units 110 may be changed according to a condition in which the fluid accommodation part 100 is mounted.

The closing portions 200 close the openings 120. Each closing portion 200 is formed in a shape covering each of the openings 120 provided at both ends of the fluid accommodation part 100 so as to close the openings 120 to acoustic rigid-ended condition.

The compressibility reduction portion 300 is mounted in the fluid accommodation part 100 to reduce effective compressibility of the fluid accommodation part 100. In the present exemplary embodiment, the compressibility reduction portion 300 has a side hole passing through a side portion of the fluid accommodation part 100 and vents the space portion 101 to the outside.

In the present exemplary embodiment, the side hole 310 is exemplified as a hole having a certain inner diameter, i.e., a set inner diameter $2r_0$. The side hole 310 extends to have a certain length l so as to be approximately perpendicular to the lengthwise direction of the fluid accommodation part 100. One end of the side hole 310 is connected to the space portion 101 of the fluid accommodation part 100.

In the present exemplary embodiment, a plurality of compressibility reduction portions 300 are provided and arranged in the lengthwise direction of the fluid accommodation part 100. For example, a plurality of compressibility reduction portions 300 are provided per accommodation unit 110 and are arranged symmetrically with respect to the center in a lengthwise direction of the accommodation unit 110.

The acoustic resonator 10 according to the first exemplary embodiment may be manufactured by connecting the resonance units 1 in series and then blocking the openings 120 disposed at both ends thereof using the closing portions 200 to realize rigid-ended condition, the resonance units 1 each including the accommodation unit 110 and the compressibility reduction portions 300 attached to the accommodation unit 110.

Figure 3:
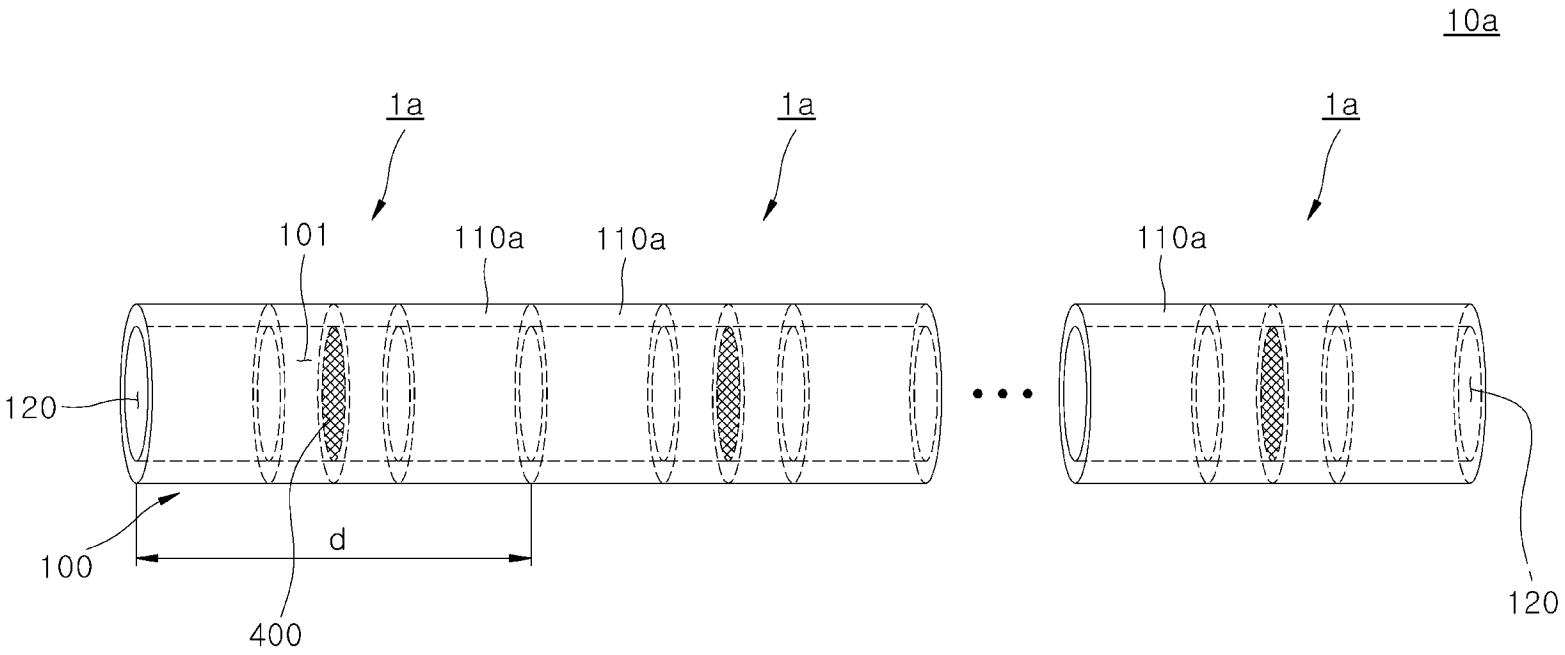
FIG. 3 is a schematic view illustrating an acoustic resonator according to a second exemplary embodiment of the present invention.

FIG. 3 is a schematic view illustrating an acoustic resonator 10*a* according to a second exemplary embodiment of the present invention. The acoustic resonator 10*a* is formed by arranging a plurality of resonance units 1*a* in series, wherein each includes an accommodation unit 110*a* and a density reduction portion 400 attached to the accommodation unit 110*a*. Referring to FIG. 3, the acoustic resonator 10*a* according to the second exemplary embodiment includes a fluid accommodation part 100 and the density reduction portion 400 to cause resonance of a sound wave input to the fluid accommodation part 100.

Unlike that the openings 120 of the fluid accommodation part 100 of the first exemplary embodiment are rigidly blocked by the closing portions 200, the fluid accommodation part 100 of the second exemplary embodiment is in an approximate pressure-release-ended condition because openings 120 formed at both sides thereof are open.

Unlike the acoustic resonator 10 of the first exemplary embodiment, the acoustic resonator 10*a* of the second exemplary embodiment includes the density reduction portion 400 and configured to partition the interior of the fluid accommodation part 100 to reduce effective density of the fluid accommodation part 100.

In the present exemplary embodiment, the density reduction portion 400 is exemplified as a thin plate or an elastic membrane configured to partition a space portion 101. In the present exemplary embodiment, the density reduction portion 400 may be exemplified as an elastic PET film or an elastic natural rubber membrane.

Figure 4:
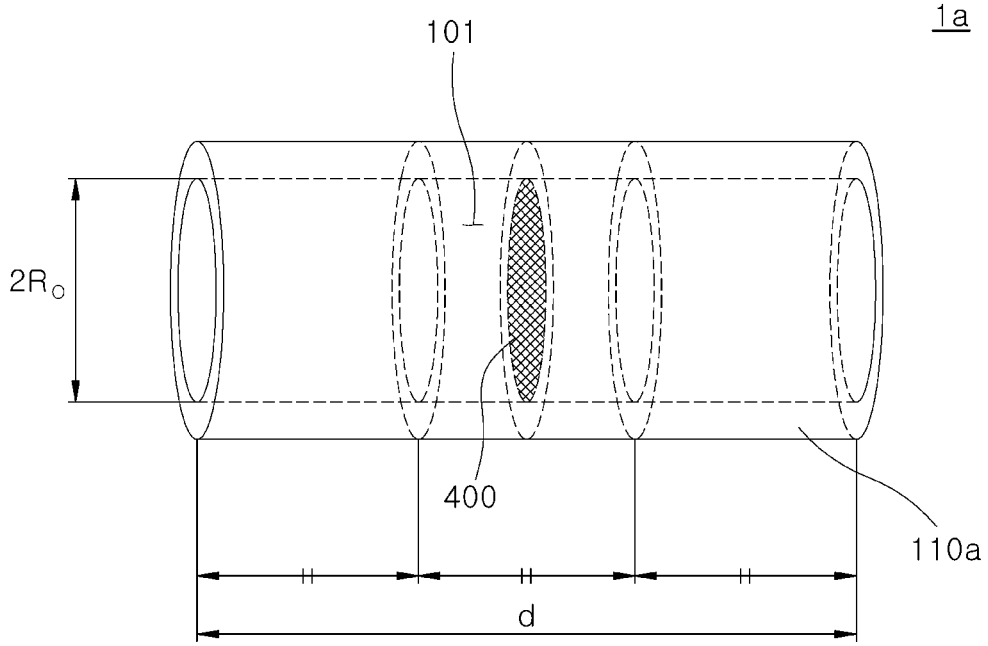
FIG. 4 is a schematic view illustrating an example of a resonance unit used in the acoustic resonator according to the second exemplary embodiment of the present invention.

FIG. 4 is a schematic view illustrating an example of the resonance unit 1*a* used in the acoustic resonator 10*a* according to the second exemplary embodiment of the present invention.

Referring to FIGS. 3 and 4, the acoustic resonator 10*a* according to the second exemplary embodiment may be manufactured by connecting the resonance units 1*a* in series, wherein each includes the accommodation unit 110*a* and the density reduction portion 400 attached to the accommodation unit 110*a*. An open condition is realized by opening the openings 120 at the both ends of the fluid accommodation part 100.

Figure 5:
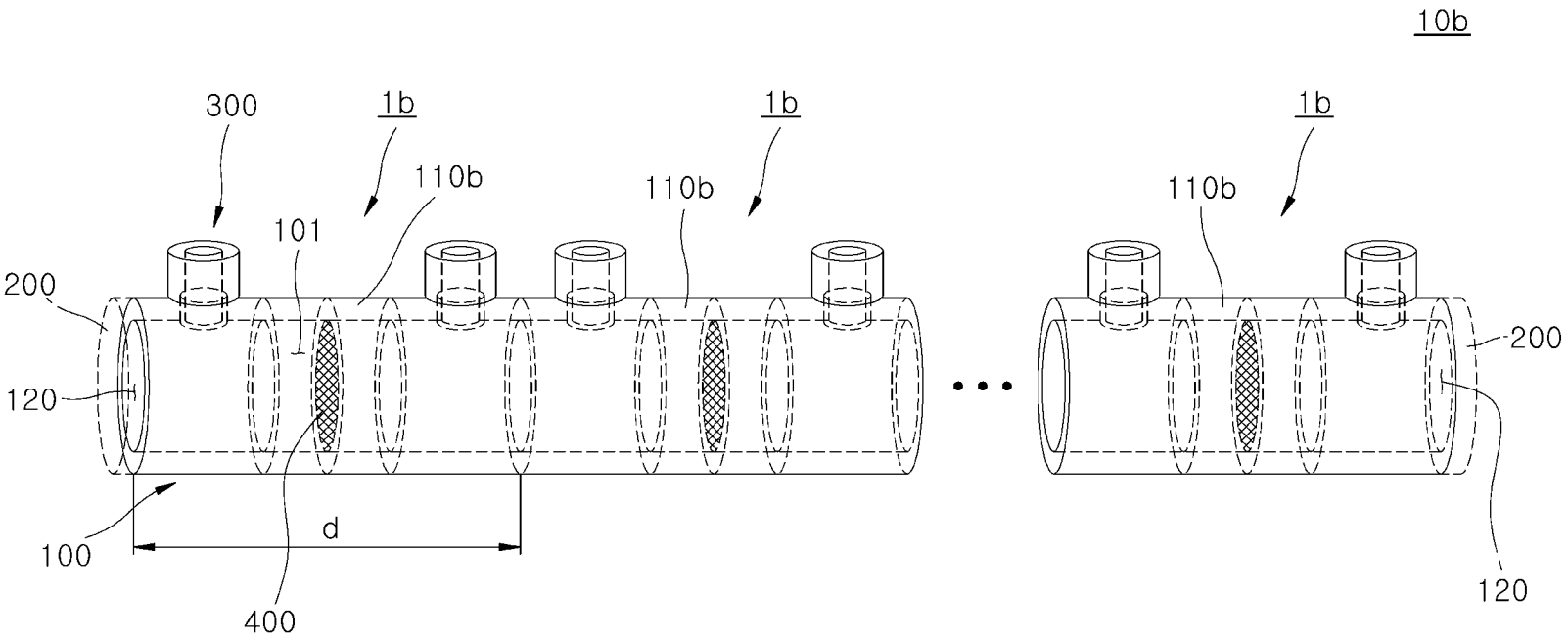
FIG. 5 is a schematic view illustrating an acoustic resonator according to a third exemplary embodiment of the present invention.
Figure 6:
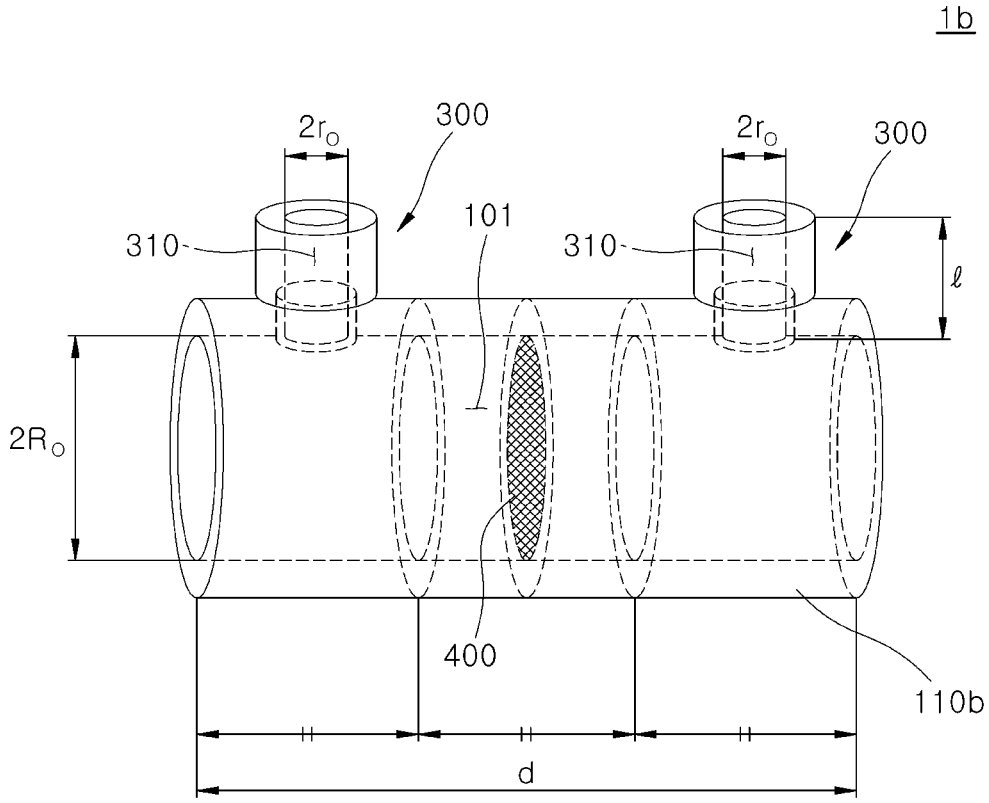
FIG. 6 is a schematic view illustrating an example of a resonance unit used in the acoustic resonator according to the third exemplary embodiment of the present invention.

FIG. 5 is a schematic view illustrating an acoustic resonator 10*b* according to a third exemplary embodiment of the present invention. The acoustic resonator 10*b* is formed by arranging a plurality of resonance units 1*b* in series, wherein each includes an accommodation unit 110*b*, compressibility reduction portions 300 attached to the accommodation unit 110*b*, and a density reduction portion 400. The acoustic resonator 10*b* further includes closing portions 200 configured to close openings 120 at both ends of the acoustic resonator 10*b*. FIG. 6 is a schematic view illustrating an example of the resonance unit 1*b* used in the acoustic resonator 10*b* according to the third exemplary embodiment of the present invention.

Referring to FIGS. 5 and 6, the acoustic resonator 10*b* according to the third exemplary embodiment may include a fluid accommodation part 100, the compressibility reduction portions 300, and the density reduction portion 400 to reduce effective compressibility and effective density. Therefore, in the acoustic resonator 10*b* according to the third exemplary embodiment, both of two resonances generated in the first exemplary embodiment and the second exemplary embodiment may be generated at each zeroth-order resonance frequency according to boundary conditions of both ends changed depending on the presence or absence of the closing portions 200.

FIG. 7 is a diagram illustrating an equivalent circuit model of the resonance unit used in the acoustic resonator 10*b* according to the third exemplary embodiment of the present invention. The behavior of a wave in the acoustic resonators 10, 10*a*, and 10*b* or the resonance units 1, 1*a*, and 1*b* may be approximately represented by the following generalized Telegraphist's Equations derived from equivalent circuit modeling.

$$\frac{dp}{dz} = -Z'_{as}q \qquad \text{[Mathematical Equation 1]}$$

$$\frac{dq}{dz} = -Y'_{ap}p, \qquad \text{[Mathematical Equation 2]}$$

where p is acoustic pressure phasor, q is volume velocity phasor, $Z'_{as}$ is acoustic series impedance per unit length of a medium, and $Y'_{ap}$ is acoustic shunt admittance per unit length of the medium.

The acoustic resonators 10, 10*a*, and 10*b* constructed by mounting the density reduction portion 400 exemplified as the thin plate and the compressibility reduction portion 300 having the side hole 310 with a circular cross section in the one dimensional fluid accommodation part 100 as a basic medium may be considered as an acoustic resonator made of an acoustic composite right/left-handed (CRLH) metamaterial. A unit of the acoustic CRLH metamaterial, i.e., the resonance units 1, 1*a*, and 1*b* may be modeled using discrete series impedance $Z_{as}$ and discrete shunt admittance $Y_{ap}$.

In this case, $Z'_{as}$ and $Y'_{ap}$ of generalized Telegraphist's Equations may be obtained from $Z_{as}/d$ and $Y_{ap}/d$ (d: a physical length of the accommodation unit 110, 110*a*, and 110*b*). The behavior of a wave in the acoustic resonators 10, 10*a*, and 10*b* may be approximately represented by generalized Telegraphist's Equations, only in a frequency range in which an effectively homogeneous condition of $d<\lambda_g/4$ is satisfied (wherein $\lambda_g$ indicates the wavelength in the lengthwise direction of the fluid accommodation part 100).

Regarding the equivalent circuit model of the acoustic resonator 10*b* according to the third exemplary embodiment, an equivalent circuit of an acoustic CRLH metamaterial unit constituting the acoustic resonator 10*b* according to the third exemplary embodiment consists of one series impedance $Z_{as}$ and two shunt admittances $Y_{ap}/2$. $Z_{as}$ and $Y_{ap}$ are generally complex numbers, and values thereof are obtained as follows.

Even in the case of an acoustic CRLH metamaterial unit constituting the acoustic resonators 10 and 10*a* according to the first and second exemplary embodiments, Mathematical Equations 3 and 4 below are satisfied. In the first exemplary embodiment, $C_{as}$ is infinity, and in the second exemplary embodiment, $m_{ap}$ is infinity.

$$Z_{as} = r + j\left(\omega m_{as} - \frac{1}{\omega C_{as}}\right) \quad \text{[Mathematical Equation 3]}$$

$$Y_{ap} = g + j\left(\omega C_{ap} - \frac{1}{\omega m_{ap}}\right), \quad \text{[Mathematical Equation 4]}$$

where r is acoustic series resistance of the acoustic CRLH metamaterial unit constituting the acoustic resonators 10, 10*a*, and 10*b*, $m_{as}$ is acoustic series inertance of the acoustic CRLH metamaterial unit constituting the acoustic resonators 10, 10*a*, and 10*b*, $C_{as}$ is acoustic series compliance of the acoustic CRLH metamaterial unit constituting the acoustic resonators 10, 10*a*, and 10*b*, g is acoustic shunt conductance of the acoustic CRLH metamaterial unit constituting the acoustic resonators 10, 10*a*, and 10*b*, $C_{ap}$ is acoustic shunt compliance of the acoustic CRLH metamaterial unit constituting the acoustic resonators 10, 10*a*, and 10*b*, and $m_{ap}$ is acoustic shunt inertance of the acoustic CRLH metamaterial unit constituting the acoustic resonators 10, 10*a*, and 10*b*.

Here, effective compressibility $Y_{ap}/j\omega Ad$ of the acoustic resonators 10, 10*a*, and 10*b* may be obtained from shunt admittance $Y_{ap}$ (wherein A indicates a cross-sectional area of the fluid accommodation part 100). A zeroth-order resonance of the acoustic resonators 10 and 10*b*, of which both ends are rigid, is generated at a frequency in which a real part of the effective compressibility is zero. In this case, a resonance frequency and a Q factor are as follows:

$$\omega_{res}^{rigid} - \frac{1}{\sqrt{m_{ap}C_{ap}}} \quad \text{[Mathematical Equation 5]}$$

-continued $$Q_0^{rigid} = \frac{1}{g}\sqrt{\frac{C_{ap}}{m_{ap}}}. \quad \text{[Mathematical Equation 6]}$$

In addition, effective density $Z_{as}A/j\omega d$ of the acoustic resonators 10, 10*a*, and 10*b* may be obtained from series impedance $Z_{as}$. A zeroth-order resonance of the acoustic resonators 10*a* and 10*b*, of which both ends are in an open condition (i.e., approximate pressure-release-ended condition), is generated at a frequency in which a real part of the effective density is zero. In this case, a resonance frequency and a Q factor are as follows:

$$\omega_{res}^{P.R.} - \frac{1}{\sqrt{m_{as}C_{as}}} \quad \text{[Mathematical Equation 7]}$$

$$Q_0^{P.R.} - \frac{1}{r}\sqrt{\frac{C_{as}}{m_{as}}}. \quad \text{[Mathematical Equation 8]}$$

When any one of effective acoustic inertance and effective acoustic compliance becomes zero, the pressure inside the fluid accommodation part 100 is uniform, or the fluid particles uniformly oscillate, so that the fluid accommodation part 100 has an overall uniform sound field distribution therein.

That is, since a sound field in the fluid accommodation part 100 is formed flat, a wavelength is infinite. Thus, the acoustic resonators 10, 10*a*, and 10*b* may have a desired resonance frequency or Q factor by using the fluid accommodation part 100 having the same length, or the length of the fluid accommodation parts 100, i.e., the length of the acoustic resonators 10, 10*a*, and 10*b* may be adjusted to a desired length while the acoustic resonators 10, 10*a*, and 10*b* has a fixed resonance frequency and Q factor.

Hereinafter, characteristics of the acoustic resonators 10, 10*a*, and 10*b* will be described based on some results of simulating a resonance phenomenon of a device by which the most general acoustic CRLH metamaterial resonator, that is the acoustic resonator 10*b* of the third exemplary embodiment, is implemented, by using an infinite element method (FEM) tool, i.e., COMSOL Multiphysics.

First, the sound field and the resonance frequency of a zeroth-order resonance according to a change of boundary condition at both ends of the acoustic resonator 10*b* were checked through simulation. When a single boundary condition was equally set at both ends of the acoustic resonator 10*b* consisting of five accommodation units 110*b*, a sound field formed in the acoustic resonator 10*b* was simulated according to a frequency.

In each of the resonance units 1*b* constituting the acoustic resonator 10*b*, the accommodation unit 110*b* had an inner diameter $2R_0$ of 32.9 mm and a length d of 72.0 mm Two compressibility reduction portions 300 each having the side hole 310, and the density reduction portion 400 composed of one thin plate were mounted in the accommodation unit 110*b*. Each of the resonance units 1*b* was configured to have a symmetric structure.

In the state in which both ends of the acoustic resonator 10*b* were rigidly closed or were open to air, the simulation was performed in a frequency region of 330.0 Hz to 1,000.0 Hz including a passband frequency of the acoustic resonator 10*b*.

Figure 8:
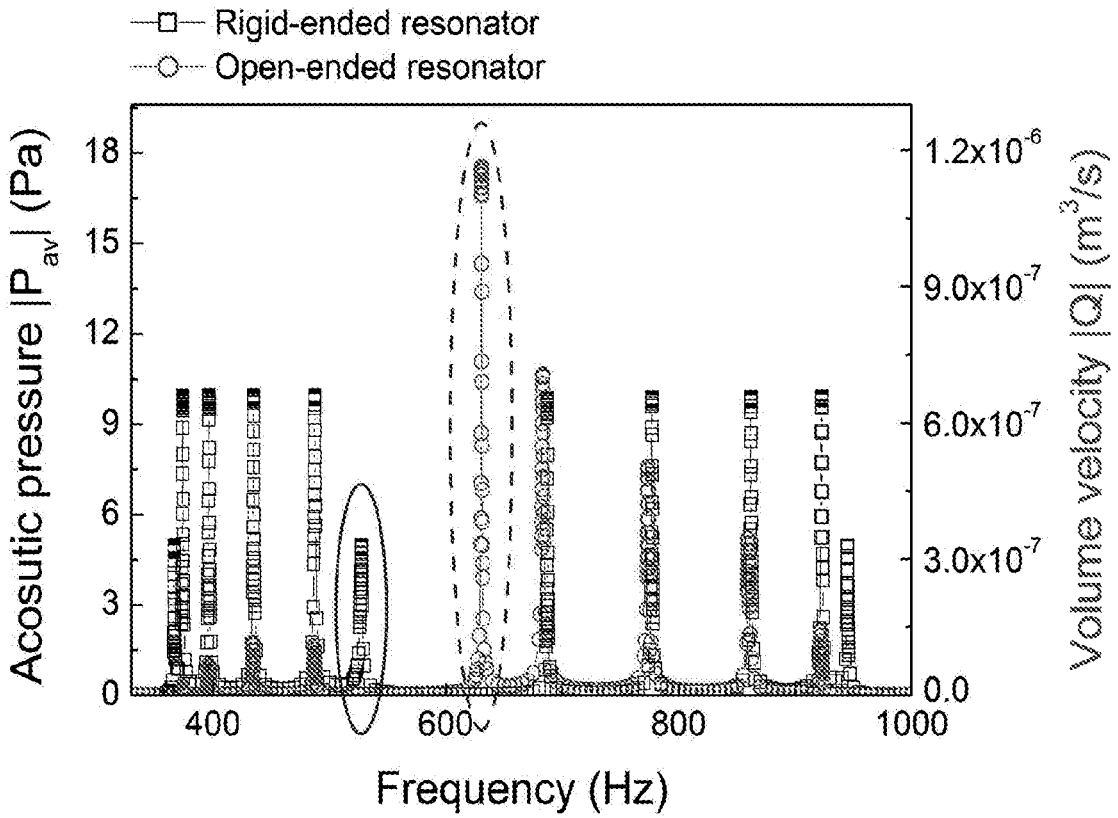
FIG. 8 is a graph showing resonance spectra according to the change of boundary condition at both ends of an acoustic resonator according to an exemplary embodiment of the present invention.

FIG. 8 is a graph showing resonance spectra according to the change of boundary condition at both ends of an acoustic resonator according to the third exemplary embodiment of the present invention. FIG. 8 shows resonance spectra measured at the right end face of the acoustic resonator 10*b* from the simulation result.

In FIG. 8, the square symbol indicates the acoustic pressure averaged over the cross section of the fluid accommodation part 100 when both ends of the acoustic resonator 10*b* according to the third exemplary embodiment are rigidly closed. The circular symbol indicates volume velocity obtained by integrating particle velocity over the cross section of the fluid accommodation part 100 when the both ends of the acoustic resonator 10*b* according to the third exemplary embodiment are open to outside air.

It can be confirmed in these resonance spectra that, unlike other resonances, the resonance frequency of a zeroth-order resonance is considerably changed when the boundary condition at the both ends of the acoustic resonator 10*b* according to the third exemplary embodiment becomes opposite.

When the both ends of the acoustic resonator 10*b* were rigidly closed, a zeroth-order resonance was generated at a frequency of 527.2 Hz, and when the both ends of the acoustic resonator 10*b* were open to outside air, a zeroth-order resonance was generated at a frequency of 630.6 Hz. These match well with the results theoretically obtained by Mathematical Equations 5 and 7.

When both ends of an acoustic resonator are rigidly closed, a zeroth-order resonance can be observed when acoustic pressure in the acoustic resonator is measured, and when the both ends of the acoustic resonator are open to outside air, a zeroth-order resonance can be observed when particle velocity in the acoustic resonator is measured.

Figure 9:
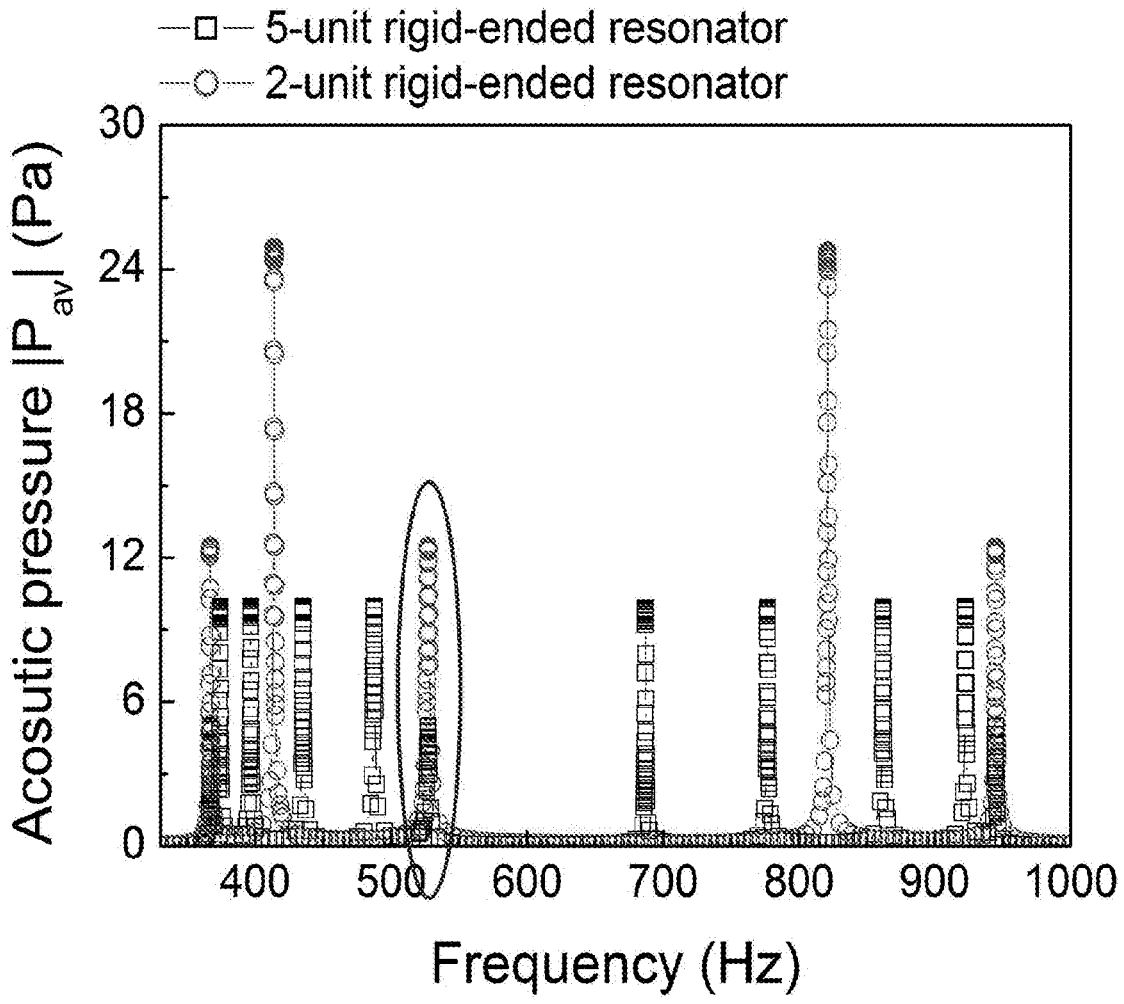
FIG. 9 is a graph showing resonance spectra of acoustic resonator according to the number of accommodation units constituting a fluid accommodation part in the state in which both ends of the acoustic resonator according to an exemplary embodiment of the present invention are closed.
Figure 10:
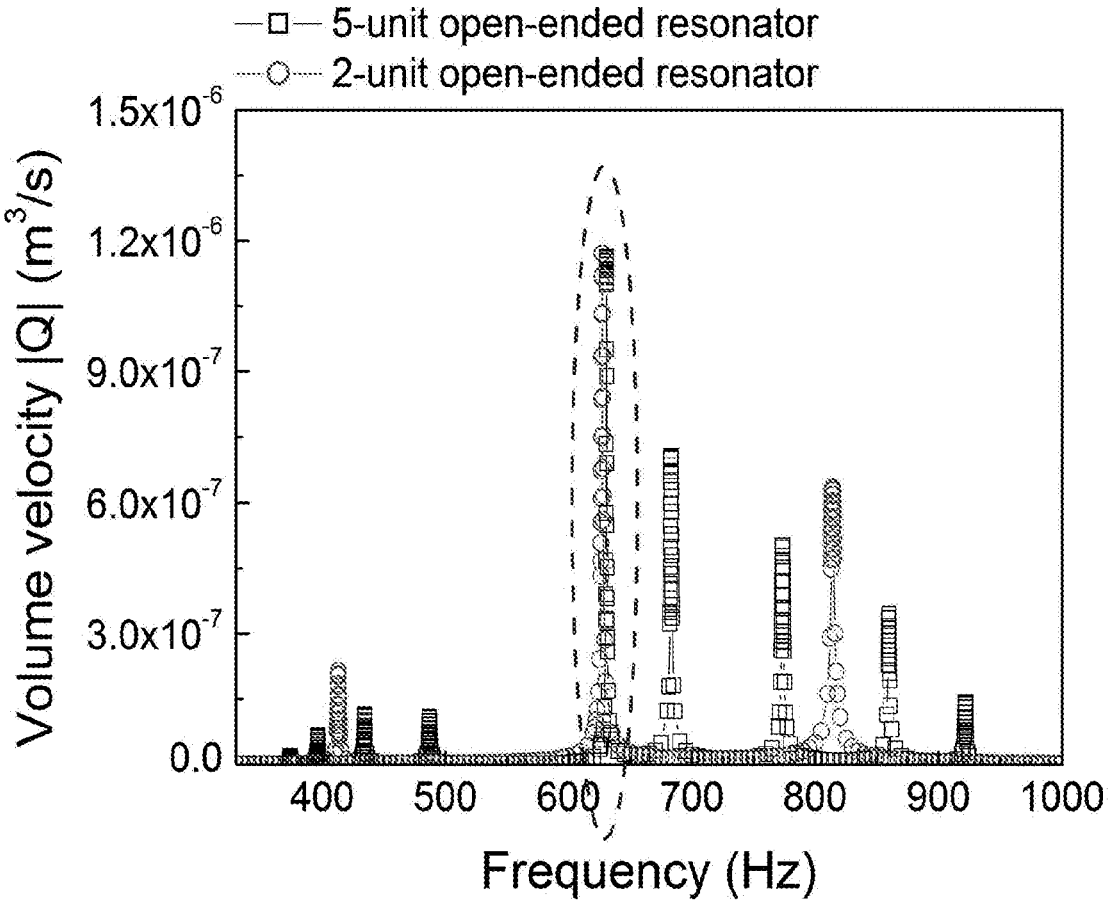
FIG. 10 is a graph showing resonance spectra of acoustic resonator according to the number of accommodation units constituting a fluid accommodation part in the state in which both ends of the acoustic resonator according to an exemplary embodiment of the present invention are open.

FIG. 9 is a graph showing resonance spectra of acoustic resonator according to the number of accommodation units constituting a fluid accommodation part in the state in which both ends of the acoustic resonator 10*b* according to the third exemplary embodiment of the present invention are closed. FIG. 10 is a graph showing resonance spectra of acoustic resonator according to the number of accommodation units constituting a fluid accommodation part in the state in which both ends of the acoustic resonator 10*b* according to the third exemplary embodiment of the present invention are open.

Referring to FIGS. 9 and 10 obtained from a simulation, we can see how the resonance frequency and the Q factor of a zeroth-order resonance vary with the number of the accommodation units, which constitute the fluid accommodation part 100 constituting the acoustic resonator 10*b* according to the third exemplary embodiment, is changed.

In the state in which the number of the accommodation units, which constitute the fluid accommodation part 100 of the acoustic resonator 10*b* according to the third exemplary embodiment, was reduced to two and all other simulation conditions were set as the same as in modeling in which the number of the accommodation units constituting the fluid accommodation part 100 was set to five, a sound field, which was formed in the acoustic resonator 10*b* according to the third exemplary embodiment, was simulated. As a result, unlike non-zeroth-order resonances (m= . . . , −2, −1, 1, 2, . . . ), the resonance frequency of a zeroth-order resonance was barely changed in both cases of a case in which both ends of the acoustic resonator 10*b* were rigidly closed and a case in which both ends of the acoustic resonator 10*b* were open to outside air.

This means that the resonance frequency of the zeroth-order resonance is not changed due to the change of the length of the acoustic resonator 10*b* according to the third exemplary embodiment, which is quantitatively described by Mathematical Equations 5 and 7 which are theoretically obtained.

Figure 11:
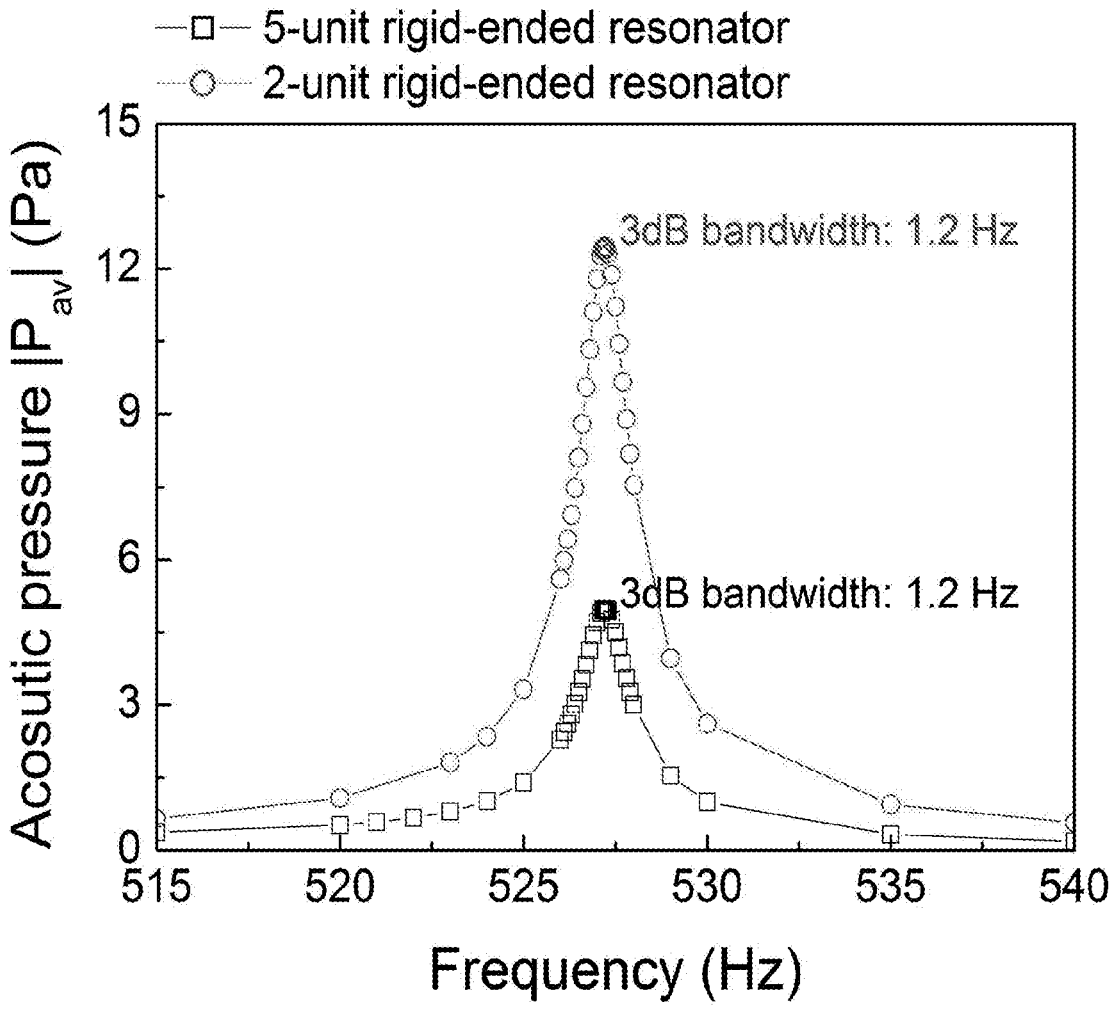
FIG. 11 is a graph showing peaks of a zeroth-order resonance of acoustic resonator according to the number of accommodation units constituting a fluid accommodation part in the state in which both ends of the acoustic resonator according to an exemplary embodiment of the present invention are closed.
Figure 12:
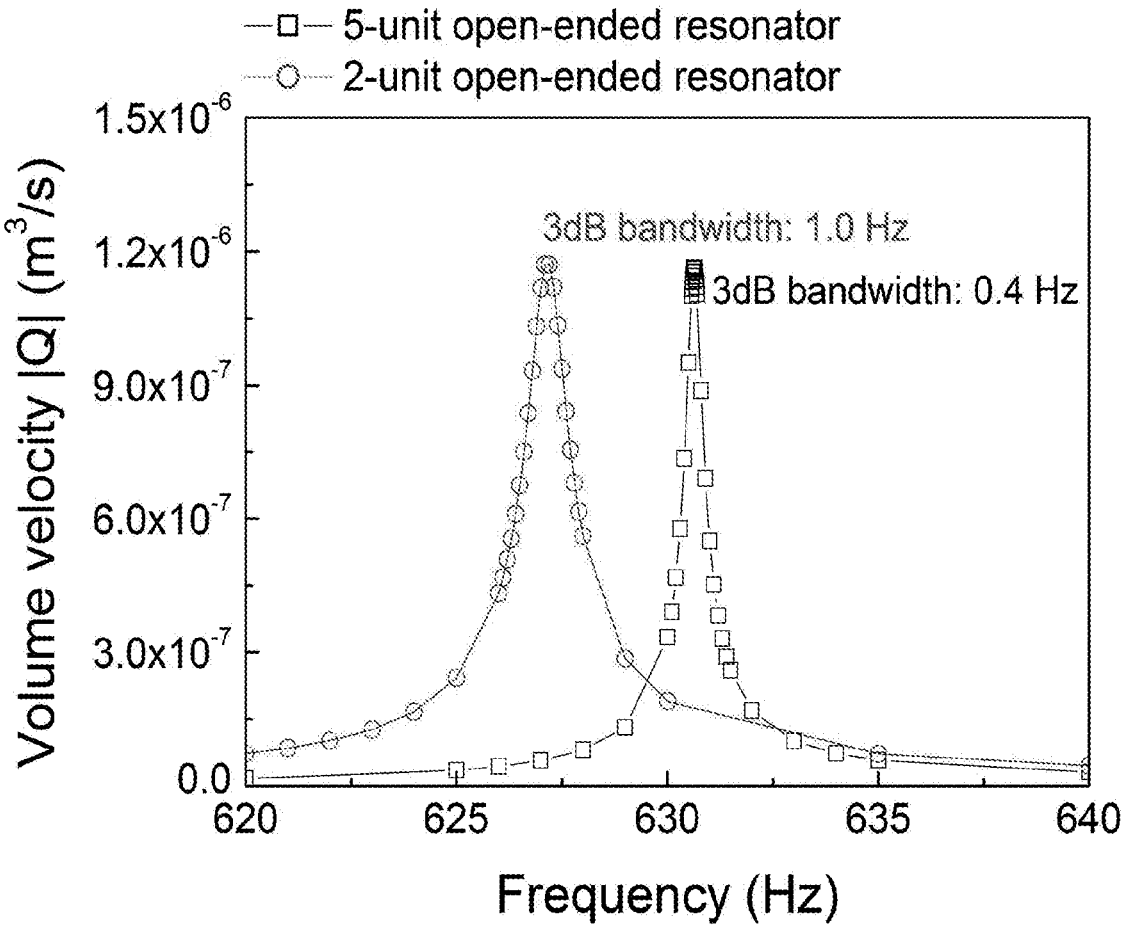
FIG. 12 is a graph showing peaks of a zeroth-order resonance of acoustic resonator according to the number of accommodation units constituting a fluid accommodation part in the state in which the both ends of the acoustic resonator according to an exemplary embodiment of the present invention are open.

FIG. 11 is a graph showing peaks of a zeroth-order resonance of acoustic resonator according to the number of accommodation units constituting a fluid accommodation part in the state in which both ends of the acoustic resonator according to an exemplary embodiment of the present invention are closed. FIG. 12 is a graph showing peaks of a zeroth-order resonance of acoustic resonator according to the number of accommodation units constituting a fluid accommodation part in the state in which the both ends of the acoustic resonator according to the exemplary embodiment of the present invention are open.

Referring to FIGS. 11 and 12, when the acoustic resonator 10*b* according to the third exemplary embodiment was rigidly closed, although the number of the accommodation units, which constitute the fluid accommodation part 100 of the acoustic resonator 10*b*, was reduced or increased, the Q factor of a zeroth-order resonance was not changed.

This is quantitatively well described by Mathematical Equation 6 which is theoretically obtained. When the both ends of the acoustic resonator 10*b* according to the third exemplary embodiment were open to outside air, the Q factor of a zeroth-order resonance was slightly changed.

Such a result is because radiation loss is equally generated at the both ends of the acoustic resonator 10*b* according to the third exemplary embodiment, regardless of the number of the accommodation units constituting the fluid accommodation part 100 of the acoustic resonator 10*b* according to the third exemplary embodiment. That is to say, radiation loss per one accommodation unit varies according to the number of the accommodation units constituting the fluid accommodation part 100 of the acoustic resonator 10*b* according to the third exemplary embodiment. The result shows that except for such difference due to radiation loss, even when the both ends are open, the Q factor of a zeroth-order resonance is not changed although the number of the accommodation units, which constitute the fluid accommodation part 100 of the acoustic resonator 10*b*, is reduced or increased.

Accordingly, the acoustic resonators 10, 10*a*, and 10*b* according to the three exemplary embodiments may have a desired resonance frequency or Q factor with a fixed length of the fluid accommodation part 100, or may be designed to have a desired length as well as a fixed resonance frequency or Q factor.

An acoustic resonator according to the present invention is made of an acoustic CRLH metamaterial having a property in which effective compressibility and effective density are gradually decrease as frequency decreases. Thus, the acoustic resonator according to the present invention has an overall uniform sound field distribution at the frequencies at which the real part of any one of effective compressibility and effective density is zero.

Therefore, the acoustic resonator can realize a desired resonance frequency or Q factor at a state in which a length thereof is fixed, or a length thereof can be adjusted while the acoustic resonator has a fixed resonance frequency or Q factor. The acoustic resonator is a basic acoustic device, of which an application field is very wide. The present invention can be widely applied to various industrial fields as source technology contributing to improvement of performance of the basic acoustic device.

Although the exemplary embodiments of the present invention have been described with reference to the accompanying drawings, they are only examples. It will be appreciated by those skilled in the art that various modifications and equivalent other embodiments are possible from the present invention. Accordingly, the actual technical protection scope of the present invention must be determined by the spirit of the appended claims.

What is claimed is:

1. An acoustic resonator comprising:

a fluid accommodation part comprising a plurality of accommodation units connected to each other, each accommodation unit having a space portion configured to accommodate a fluid, and openings located at both ends of the space portion;

closing portions configured to close end openings located at both ends of the fluid accommodation part; and a compressibility reduction portion configured to vent the space portion to reduce effective compressibility of the fluid accommodation part, wherein the fluid accommodation part is formed by connecting two or more accommodation units each having a length shorter than a wavelength of an applied sound wave, and a zeroth-order resonance frequency $\omega^{rigid}_{res}$ is represented by $$\omega^{rigid}_{res} = \frac{1}{\sqrt{m_{ap}C_{ap}}},$$

wherein $m_{ap}$ is acoustic shunt inertance of a resonance unit including an accommodation unit and the compressibility reduction portion mounted in the accommodation unit, and $C_{ap}$ is acoustic shunt compliance of the resonance unit.

2. The acoustic resonator of claim 1, wherein the space portion is formed to pass through the fluid accommodation part in a lengthwise direction of the fluid accommodation part.

3. The acoustic resonator of claim 2, wherein air is accommodated in the space portion, and the fluid accommodation part is made with a material having acoustic impedance greater than that of the air.

4. The acoustic resonator of claim 1, wherein the plurality of accommodation units are arranged and connected to each other in series.

5. The acoustic resonator of claim 1, wherein the compressibility reduction portion has a side hole passing through the fluid accommodation part and vents the space portion to the outside.

6. The acoustic resonator of claim 5, wherein the plurality of compressibility reduction portions are provided and arranged in a lengthwise direction of the fluid accommodation part.

7. The acoustic resonator of claim 6, wherein the plurality of compressibility reduction portions are provided in each accommodation unit and are arranged symmetrically with respect to a center in a lengthwise direction of each accommodation unit.

8. The acoustic resonator of claim 1, further comprising a density reduction portion configured to partition the space portion to reduce effective density of the fluid accommodation part.

9. The acoustic resonator of claim 8, wherein the density reduction portion is composed of an elastic membrane which partitions the space portion.

10. The acoustic resonator of claim 9, wherein a plurality of density reduction portions are provided and arranged in a lengthwise direction of the fluid accommodation part.

11. The acoustic resonator of claim 9, wherein the fluid accommodation part is formed by connecting the plurality of accommodation units, and a plurality of density reduction portions are provided in each accommodation unit and are arranged symmetrically with respect to a center in a lengthwise direction of each accommodation unit.

12. An acoustic resonator comprising:

a fluid accommodation part comprising a plurality of accommodation units connected to each other, each accommodation unit having a space portion configured to accommodate a fluid, and openings located at both ends of the space portion; and a density reduction portion mounted in the fluid accommodation part and configured to partition the space portion to reduce effective density of the fluid accommodation part, wherein the fluid accommodation part is formed by connecting two or more accommodation units each having a length shorter than a wavelength of an applied sound wave, and a zeroth-order resonance frequency $\omega^{P.R.}_{res}$ is represented by $$\omega^{P.R.}_{res} = \frac{1}{\sqrt{m_{as}C_{as}}},$$

wherein $m_{as}$ is acoustic series inertance of a resonance unit including an accommodation unit and the density reduction portion mounted in the accommodation unit, and $C_{as}$ is acoustic series compliance of the resonance unit.

13. The acoustic resonator of claim 12, wherein the space portion is formed to pass through the fluid accommodation part in a lengthwise direction of the fluid accommodation part.

14. The acoustic resonator of claim 13, wherein air is accommodated in the space portion, and the fluid accommodation part is made with a material having acoustic impedance greater than that of the air.

15. The acoustic resonator of claim 12, wherein the density reduction portion is composed of an elastic membrane which partitions the space portion.

16. The acoustic resonator of claim 12, further comprising a compressibility reduction portion configured to vent the space portion to reduce effective density of the fluid accommodation part.

* * * * *